US005166705A

United States Patent [19]

Roh

[11] Patent Number: 5,166,705

[45] Date of Patent: Nov. 24, 1992

[54] APPARATUS FOR HOLDING A PAPER IN A VIDEO PRINTER

[75] Inventor: Kwang-Ho Roh, Kyounggi, Rep. of Korea

[73] Assignee: Samsung Electronics Co., Ltd., Suwon, Rep. of Korea

[21] Appl. No.: 541,739

[22] Filed: Jun. 21, 1990

[30] Foreign Application Priority Data

Jun. 22, 1989 [KR] Rep. of Korea ..... 1989-8642

[51] Int. Cl.[5] ..... B41J 13/22

[52] U.S. Cl. ..... 346/138; 271/277

[58] Field of Search ..... 346/76 PH, 136, 134, 346/138; 271/275, 277, 205, 82; 355/73, 76, 315; 101/409; 400/120 MP

[56] References Cited

U.S. PATENT DOCUMENTS 4,111,119 9/1978 Takizawa et al. ..... 346/138

4,543,004 9/1985 Brandenburg et al. ..... 101/409

*Primary Examiner*—Benjamin R. Fuller
*Assistant Examiner*—N. Le
*Attorney, Agent, or Firm*—Robert E. Bushnell

[57] ABSTRACT

An apparatus for holding a paper for use in a color video printer is disclosed. The apparatus reproduces the video signal on a paper fast and precisely by preventing the thermal head from random up or down movement. The improvement includes: a platen drum for rotating the paper; a thermal head for radiating heat according to a video signal input; a color ribbon disposed between the thermal head and the paper, for reproducing the video signal on the paper in response to the heat radiated from the thermal head; and means controllably coupled to the platen drum, for holding the paper upon the platen drum, the holding means being mounted at only both end of the platen drum.

8 Claims, 3 Drawing Sheets

APPARATUS FOR HOLDING A PAPER IN A VIDEO PRINTER

BACKGROUND OF THE INVENTION

1. Field of the Invention

This invention relates to an apparatus for holding a paper upon a platen drum of a video printer. In particular, this invention relates to a paper holding apparatus having two holding members mounted only on both ends of the platen drum, so that the apparatus allows a video printer to be able to print video signals on the paper fast by preventing a thermal head from making an random vertical up or down movement.

2. Description of the Background Art

In general, a video printer (in particular, a color video printer) uses a three-color ribbon in order to freely express or reproduce full colors of the video signal. The three-color ribbon is widely divided into a number first parts of having the components of Yellow, Magenta and Cyan and a number of second parts which have a separation strip for separating a set of the three-color components from an adjacent set of three color compounds.

A known color video printer which employs the three-color ribbon to print full colors of the video signal, should rotate the paper three times sequentially with the paper being held fixedly on the surface of the platen drum. A three-color ribbon is placed between the paper and the thermal head. In order to freely express the entire gradations of the colors, the video printer should precisely control the thermal sublimation (radiation). In this way of reproducing the video signal, there is a need for the paper to be rotated once placed fixedly on the platen drum of the video printer. For this purpose, the video printer generally requires a paper holding apparatus.

As illustrated in FIG. 1, a video printer having such a conventional paper holding apparatus therefor is presented. This video printer includes a platen drum 52 for rotating a paper 51, a paper holding apparatus for fixedly holding the paper 51 on the surface of the platen drum 52, a color ribbon 61, a ribbon cartridge 60 and a thermal head 54 for controlling the thermal sublimation of the color ribbon 61.

Referring to FIG. 3, there is shown a cross sectional view along the line A—A' of FIG. 1, taken when the paper holding apparatus 53 passes through and under the thermal head 54. As generally understood, the thermal head 54 should rise periodically in order to avoid collision with the paper holding apparatus 53 while printing the video signals. In other words, the paper 51 which is fixedly held on the surface of the platen drum 52 by means of the paper holding apparatus 53 will be rotated three times sequentially so as to reproduce a complete sheet of a video image. In this case, for every rotational period of the platen drum 52 the thermal head 54 should make movement. Therefore, it is a significant problem of the conventional paper holding apparatus is that the video printer takes a relatively long printing time. This is because of the vertical movement of the thermal head 54 and that the video printer requires a control circuit for controlling the vertical movement and a control mechanism. The precision of printing video signal may also be reduced undesirably because of the vertical movement.

The length of the color ribbon 61 must be increased to an extent that corresponds to the time required for the paper holding apparatus to pass through and under the thermal head 54. Therefore for the conventional video printer causes an undesirable waste of the color ribbon.

SUMMARY OF THE INVENTION

It is an object of the present invention to provide a paper holding apparatus for printing video signals without a vertical movement of a thermal head in a video printer.

It is another object of the present invention to provide a color video printer capable of reducing the printing time of the video signal by eliminating the vertical movement of a thermal head.

It is another object of the present invention to provide a color video printer capable of precisely printing the video signals by reducing the mechanical operation of a thermal head.

It is still another object of the present invention to provide a color video printer for saving color ribbon by sequentially carrying out the printing operation without the vertical movement of the thermal head.

It is still another object of the present invention to provide a simple, small-sized color video printer by eliminating a control circuit for controlling the vertical movement of a thermal head and a control mechanism therefore.

According to an aspect of the present invention, an apparatus for holding a paper for use in a color video printer includes: a platen drum for rotating the paper; a thermal head for radiating heat according to a video signal input; a color ribbon disposed between the thermal head and the paper, for reproducing the video signal on the paper in response to the heat radiated from the thermal head; and means controllably, coupled to the platen drum, for holding the paper upon the platen drum, the holding means being mounted at only both end of the platen drum.

BRIEF DESCRIPTION OF THE DRAWINGS

For a better understanding of the invention and to show how the same may be carried into effect reference will now be made by way of example to the accompanying drawings, in which.

DETAILED DESCRIPTION OF THE PREFERRED EMBODIMENT

Figure 1:
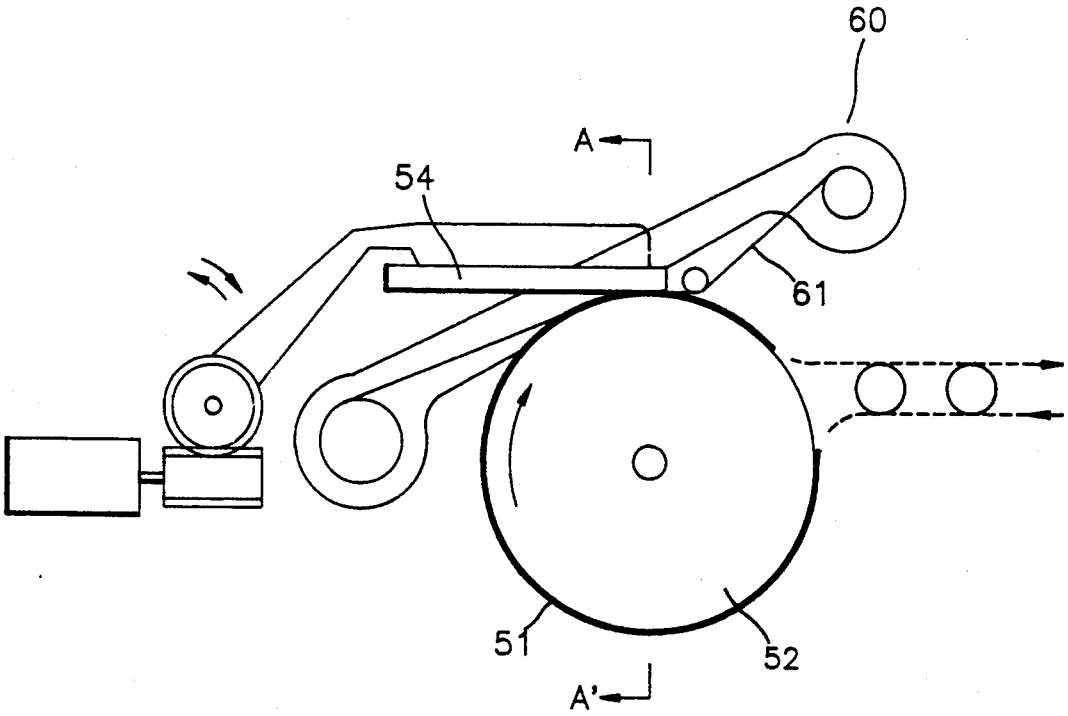
(PRIOR ART) FIG. 1
FIG. 1 illustrates a schematic view of an operation of a paper holding apparatus and a platen drum in a conventional video printer.
Figure 2:
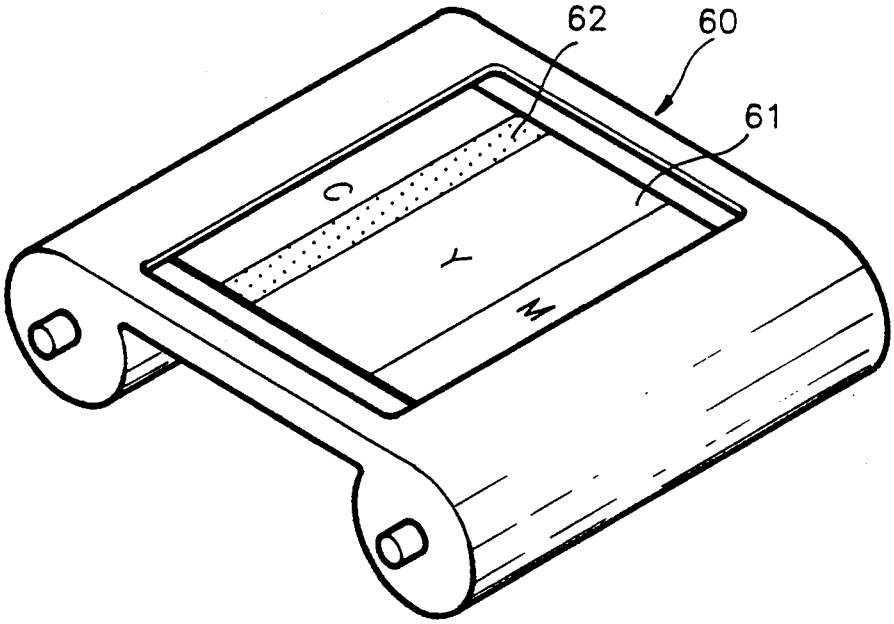
FIG. 2 illustrates a perspective view of a sublimation color ribbon and a ribbon cartridge therefor used in a color video printer.
Figure 3:
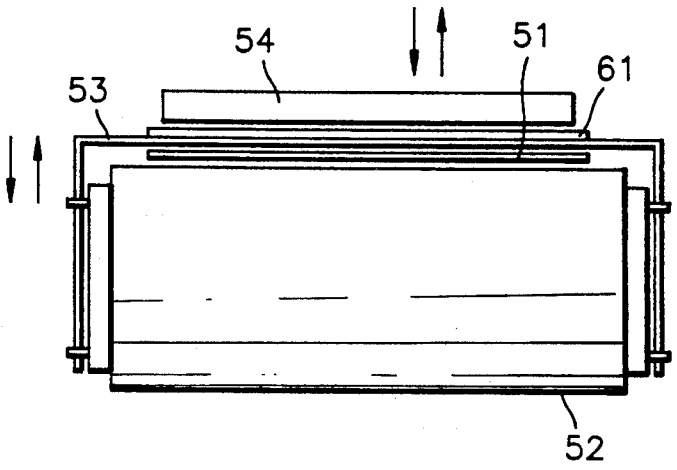
(PRIOR ART) FIG. 3
FIG. 3 illustrates a cross sectional view of a paper holding apparatus and a platen drum taken along with the line A—A' of FIG. 1 used in a conventional color video printer.
Figure 5:
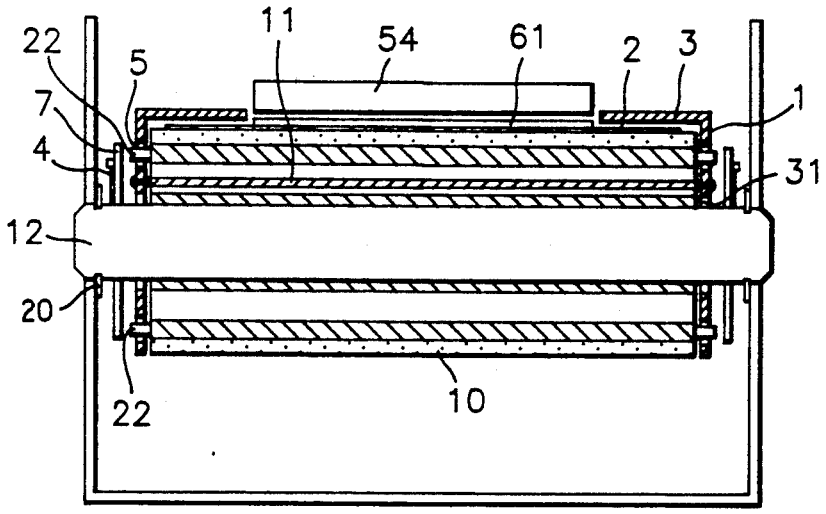
FIG. 5 illustrates a cross sectional view of the paper holding apparatus and the platen drum taken along with a line B—B' of FIG. 4 according to the present invention.
Figure 4:
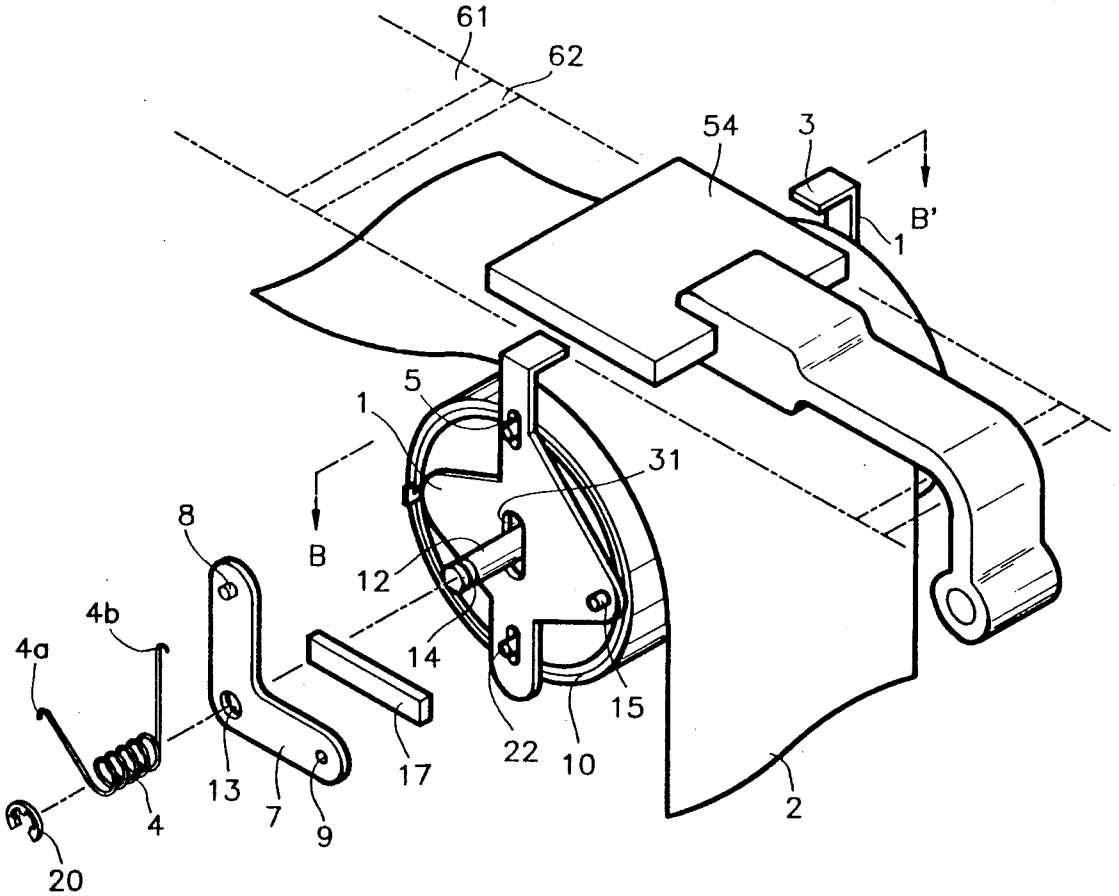
FIG. 4 illustrates a detailed portion explored view of a platen drum and a paper holding apparatus combined with the platen drum according to the present invention.

Referring to FIGS. 4 and 5, paper holding apparatus 1 are mounted at both ends of a platen drum 10 by being fixed with a stiffening bar 11 which is placed within the platen drum 10 along the central axis of the platen drum 10. The respective paper holding apparatuses 1 are folded substantially in 90 degree angles facing the outmost surface of the platen drum 10 (which will be referred to as press-down members 3 for convenience). The press-down members 3 are the portions which essentially hold the paper 2 fixedly upon the outmost surface of the platen drum 10.

In addition, the respective paper holding apparatuses 1 has an opening 31 which is formed in a long shape toward the press-down members 3. At the both ends of the opening 31, a pair of guide openings 5 are formed at a specific distance. The respective guide openings 5 are movably coupled to a pair of guide pins 22 extended at the stiffening bar 11 so as to assist the paper holding apparatus 1 to move up and down. Furthermore, at an end of the respective paper holding apparatuses 1, perpendicularly to a line between the guide openings 5, a pin 15 is coupled to an, L-shaped plate 7 by being inserted in to an opening 9. On the opposite side of the pin 15, a spring holder 8 is formed on the stiffening bar 11 for supporting an end 4*a* of an L-shaped spring 4. The L-shaped spring 4 of which the other end 4*b* is held at a pin 8, pivots the paper holding apparatuses 1 upon the opening 31.

Moreover, the L-shaped plate 7 has a through-hole 13 formed in proximity to curve thereof and a spring holder 8. The through-hole 13 will be rotatably coupled to the central axis 12. The spring holder 8 has two specific functions. One function is to hold the end 4*b* of the spring 4 and the other is to pivot the L-shaped plate 7 to a specific direction by means of a control lever 17 which operates every three rotations of the platen drum 10. Thereafter, an E-shaped ring 20 will be rotatably fitted with a groove 14 formed around at an end of the central axis 12.

In operation, when the paper 2 is loaded onto the platen drum 10, the control lever 17 pushes the spring holder 8 in the direction of the arrow in order to pivot the L-shaped plate 7 about the through hole 13. Since the L-shaped plate 7 is fixed to the paper holding apparatus 1 through the opening 9 being coupled to the pin 15, the paper holding, apparatus 1 is rotated simultaneously in a direction that presses the paper 2 down upon the outmost surface of the platen drum 10.

In this case, the guide pins 22 assure that when the paper holding apparatus 1 is provided with a rotational force through the pin 15, the paper holding apparatus 1 moves along the guide openings 5 so as to guide the paper holding apparatus 1 only upward or downward. As can be understood, it is required for the opening 31 and the guide openings 5 to be long enough to properly move up and down the paper holding apparatus 1. Therefore, the press-down member 3 can move upward high enough to load the paper 2 on the platen drum 10, when the paper 2 is loaded and when it is holding the paper 2, the press-down member 3 can fixedly hold the paper 2 on the platen drum 10.

Since the L-shaped spring 4 normally forces the paper holding apparatus 1 in a direction which presses down upon the paper 2, the paper can be properly fixed on the platen drum 10. However, after three rotations of a single sheet of paper, the control lever 17 will push the spring holder 8 in a opposite direction of the arrow to release the paper 2.

It is noted that the press-down members 3 of the paper holding apparatus 1 hold only the both sides of the paper 2. Therefore, it is not required for the thermal head 54, to be moved up and down. In addition, because the or vertical movement of the thermal head 54 can be eliminated, the width of the separation strip 62 of the color, ribbon can be minimized, saving the color ribbon, thus the printing speed is improved relatively. Another advantage of the inventive video printer is the lack of a control device and control mechanism for controlling the up/down movement of the thermal head, the system can be manufactured in a small size.

While the invention has been particularly shown and described with reference to a preferred embodiment, it will be understood by those skilled in the art that modifications in detail may be made without departing from the spirit and scope of the invention.

What is claimed is:

1. An apparatus for holding a paper for use in a color video printer, comprising:

a platen drum having an exterior circumferential surface, for rotating the paper;

a thermal head for radiating heat according to a video signal input;

said platen drum and said thermal head being positioned to accommodate a color ribbon disposed between said thermal head and said paper, for reproducing an image from said video signal on said paper in response to the heat radiated from said thermal head; and means for urging the paper against said exterior circumferential surface of said platen drum while holding only portions of opposite spaced-apart lateral edges of the paper positioned externally to said exterior circumferential surface, said urging means having two separate and spaced-apart members mounted at axially opposite ends of said platen drum, and said thermal head being interposable between said

2. An apparatus for holding a paper for use in a color video printer comprising:

a platen drum for rotating the paper;

a thermal head for radiating heat according to a video signal input;

a color ribbon disposed between said thermal head and said paper, for reproducing an image from said video signal on said paper in response to the heat radiated from said thermal head; and means for holding said paper upon said platen drum, said holding means being mounted at both ends of said platen drum, comprises:

a press down member folded toward an outer surface of said platen drum, for pressing down said paper on the platen drum;

an opening formed in a long shape toward the press-down member, for guiding said holding means in a given direction;

means associated with said holding means, for pivoting said holding means;

a lever coupled to said pivoting means, for providing said pivoting means with a rotational force to a given direction so as to guide said holding means in said given direction on the basis of a selected rotational number of said platen drum; and biasing means for resiliently urging said pivoting means in an opposite direction of the force caused by said lever.

3. An apparatus as claimed in claim 2, wherein said pivoting means is an L-shaped plate having an opening formed in proximity of a curve thereof, a holder formed at one end of said L-shaped plate for supporting said biasing means and an opening for transferring said rotational force caused by the lever to said holding means.

4. An apparatus for holding a paper for use in a color video printer, comprising:

a cylindrical platen drum for rotating said paper about a rotational axis, said cylindrical platen drum having an exterior cylindrical circumferential surface and two ends;

a thermal head for radiating heat according to a video signal input;

said platen drum and thermal head being positioned to accommodate a color ribbon disposed between said thermal head and said paper, for reproducing an image from said video signal on said paper in response to the heat radiated from said thermal head; and a plurality of discrete means for urging the paper against said exterior circumferential surface of said platen drum while holding only portions of opposite spaced-apart lateral edges of the paper positioned externally to said exterior cylindrical circumferential surface, against said exterior circumferential surface, said plurality of discrete means being separately connected to said cylindrical platen drum with each of said discrete means being axially mounted at corresponding different ones of said two ends of said cylindrical platen drum.

5. An apparatus for holding a paper for use in a color video printer, comprising:

a cylindrical platen drum for rotating said paper about a rotational axis, said cylindrical platen drum having a cylindrical surface and two ends;

a thermal head for radiating heat according to a video signal input;

a color ribbon disposed between said thermal head and said paper, for reproducing an image from said video signal on said paper in response to the heat radiated from said thermal head; and a plurality of discrete means for holding paper, said holding means being separately connected to said cylindrical platen drum with each of said holding means being mounted at corresponding different ones of said two ends of said cylindrical platen drum, said holding means comprises:

a press-down member folded parallel over said cylindrical surface of said cylindrical platen drum, said press-down member selectively presses down upon the paper on said cylindrical platen drum;

a first means for guiding said holding means in a direction perpendicular to said rotational axis;

second means for guiding said holding means in a pivoting movement about said rotational axis;

means for pivoting said holding means;

a lever coupled to said means for pivoting, said lever providing said means for pivoting with a rotational force upon a selected number rotations of said cylindrical platen drum; and biasing means for resiliently urging said means for pivoting in an opposite direction of said rotational force caused by said lever.

6. An apparatus as claimed in claim 5, wherein said means for pivoting is provided by two L-shaped plates, each of said L-shaped plates being disposed to pivot about said rotational axis and having a holder for supporting said biasing means.

7. An apparatus for holding a paper for use in a color video printer, comprising:

a cylindrical platen drum for rotating said paper about a rotational axis, said cylindrical platen drum having a cylindrical surface and two ends;

means for holding paper, said means for holding paper being coupled to said cylindrical platen drum and mounted only at said two ends of said cylindrical platen drum, said means for holding paper comprising:

a press-down member folded parallel over said cylindrical surface of said cylindrical platen drum, said press-down member selectively presses down upon said paper on said cylindrical platen drum;

first means for guiding said means for holding paper in a direction perpendicular to said rotational axis;

second means for guiding said means for holding paper in a pivoting movement about said rotational axis;

means for pivoting said means for holding paper;

a lever controllably coupled to said means for pivoting, said lever providing said means for pivoting with a rotational force upon a selected number rotations of said cylindrical platen drum; and biasing means for resiliently urging said means for pivoting in an opposite direction of said rotational force caused by said lever.

8. An apparatus as claimed in claim 7, wherein said means for pivoting is provided by two L-shaped plates, each of said L-shaped plates being disposed to pivot about said rotational axis and having a holder for supporting said biasing means.

* * * * *

UNITED STATES PATENT AND TRADEMARK OFFICE

CERTIFICATE OF CORRECTION

PATENT NO. : 5,166,705
DATED : November 24, 1992
INVENTOR(S) : Kwang-Ho Roh

It is certified that error appears in the above-indentified patent and that said Letters Patent is hereby corrected as shown below:

Column 2, Line 2, delete "for";

Column 2, Line 34 delete "," after "controllably";

Column 4, Line 5, delete "," after "color";

Claim 1, Column 4, Line 37, insert --spaced-part members.-- after "said";

Claim 2, Column 4, Line 55, change "direction;" to --direction;

at least one guide opening formed in proximity o said opening, for guiding said holding means in given direction;--.

Signed and Sealed this

Twenty-eighth Day of December, 1993

Bruce Lehman

*Attest:*

BRUCE LEHMAN

*Attesting Officer*

*Commissioner of Patents and Trademarks*